US011285361B1

(12) United States Patent
Kostadis

(10) Patent No.: US 11,285,361 B1
(45) Date of Patent: Mar. 29, 2022

(54) AUTOMATED ASSEMBLY FOR STORING/REVEALING A MULTI-SEGMENT TREADMILL

(71) Applicant: Andrew Kostadis, East Windsor, NJ (US)

(72) Inventor: Andrew Kostadis, East Windsor, NJ (US)

(73) Assignee: Andrew Kostadis, East Windsor, NJ (US)

( * ) Notice: Subject to any disclaimer, the term of this patent is extended or adjusted under 35 U.S.C. 154(b) by 0 days.

(21) Appl. No.: 17/408,451

(22) Filed: Aug. 22, 2021

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC ..... A63B 22/02–0292; A63B 2210/00–58
See application file for complete search history.

(56) References Cited

U.S. PATENT DOCUMENTS

| | | | | |
|---|---|---|---|---|
| 7,695,409 | B2 * | 4/2010 | Helie | A63B 22/02 482/54 |
| 7,780,578 | B2 * | 8/2010 | Packham | A63B 22/02 482/54 |
| 10,589,147 | B1 * | 3/2020 | Kostadis | A63B 22/0235 |
| 2008/0280734 | A1 * | 11/2008 | Dickie | A63B 22/0023 482/54 |
| 2020/0215380 | A1 * | 7/2020 | Xing | A63B 22/0235 |

* cited by examiner

*Primary Examiner* — Loan B Jimenez
*Assistant Examiner* — Catrina A Letterman

(57) ABSTRACT

Automated Assembly allows storage of a multi-segment treadmill inside of an existing office/computer desk. At the push of a button, a multi-segment treadmill is automatically stored under/inside the office/computer desk and in reverse, at the push of a button the same multi-segment treadmill is placed in the working position in front of the office desk.

12 Claims, 15 Drawing Sheets

AUTOMATED ASSEMBLY FOR STORING/REVEALING A MULTI-SEGMENT TREADMILL

BACKGROUND OF THE DISCLOSURE

In the office, a multi-segment treadmill may occupy the working position in front of the office/computer desk, enabling a worker to use a computer while walking. After the walking session is over, limited office space or convenience of use may require a multi-segment treadmill to be automatically stored into/under the same office/computer desk by using available extra leg space inside of the desk.

Automated Assembly consists of a multi-segment treadmill and equipment able to store the multi-segment treadmill under/inside the office/computer desk occupying extra leg space, sharing the leg space with the person sitting at the desk while the semi-segment treadmill is in the storing position. At the push of a button, a multi-segment treadmill is automatically stored under/inside the office/computer desk and, in reverse, at the push of a button, the same multi-segment treadmill is placed in the revealing (working) position in front of the office/computer desk.

Among the previous art, Mr. Packham's patent (U.S. Pat. No. 7,780,578 B2) depicts a similar process, i.e., folding the multi-segment treadmill into/under an office/computer desk. (Mr. Packham calls his assembly an "apparatus".) However, referring to the method of storing of the treadmill under the desk, Mr. Packham stated that "the front portion 150 and the rear portion 152 may fold together." (See page 7, first paragraph from the bottom; page 8, first paragraph from the top; page 3 third paragraph from the top.) On page 6, second paragraph from the top, Mr. Packham stated that front and rear portions are "folded together."

A more general description given by Mr. Packham's patent states: "In the storage position, as shown in FIG. 4B, the front portion 150 and the rear portion 152 form an acute angle with each other." (Page 7, third paragraph from the top; claim 14; claim 36; and claim 44.)

In claims presented by this disclosure, "the outer segment" (2.1) means the same as "front portion 150" in Mr. Packham's patent and "the inner segment" (2.2) means the same as "rear portion 152" at Mr. Packham's patent. The disclosure below depicts a different transition of the multi-segment treadmill from the revealing (working) position into the storage position and vice versa, than Mr. Packham does since the rotation stops before the inner segment occupies acute angle toward the outer segment; the design prevents further rotation of segments toward each other. (Claim 1, Claim 7, and paragraph [021] Movement B.)

Furthermore, according to Mr. Packham's design, in the storage position, both front and rear portions of the treadmill are folded together. This means that both portions (front and rear, according to Mr. Packham's terminology) occupy the same position (area) in front of the legs of the person sitting at the desk. According to the claims below, the space-sharing storing position allows different segments of the multi-segment treadmill to occupy different storing positions (areas) into/inside the office/computer desk. (Claims 1 and 7.) The outer segment occupies the position above the sitting person's legs, and the inner segment occupies the position in front of the sitting person's legs.

SUMMARY OF THE DISCLOSURE

In some embodiment, an Automated Assembly includes a multi-segment treadmill, frame, one or more linear actuators connected to the frame and to the multi-segment treadmill. The actuation of linear actuators results in storing the multi-segment treadmill into/inside the office/computer desk (space-sharing storing position) from a revealing or working position (in front of the desk) and vice versa. It is also possible to use geared AC, DC, or servo motor in lieu of a linear actuator(s).

BRIEF DESCRIPTION OF THE FIGURES

Various embodiments of the presently disclosed device are shown herein with reference to the drawings, wherein:

FIGS. 9 and 10 show the frame (3) with bottom parts shaped as a channel on both sides in order to guide bottom rollers (5) attached to the multi-segment treadmill. On FIG. 10 one side of a frame is further omitted in order to show both bottom rollers (5). A motor, chain, or a string, and gears or spools, are omitted on FIGS. 9 and 10.

FIG. 11 is a schematic illustration of the storing/revealing mechanism with a motor in use instead of a linear actuator. A stored treadmill is omitted on FIG. 11.

FIGS. 12-15 are schematic illustrations of the same storing/revealing process provided by the Automated Assembly with a motor in use instead of the linear actuator (the multi-segment treadmill is storing/revealing similar to depicted on FIG. 1-4 or 5-8.)

DETAILED DESCRIPTION OF THE DISCLOSURE

This disclosure presents an Automated Assembly able to be installed under almost any existing office/computer desk by utilizing extra space arranged for a worker's legs. The segments of the multi-segment treadmill shares the leg space with the person sitting at the office/computer desk.

A small disadvantage of this disclosure is that the size of a storing multi-segment treadmill may be limited by the sizes of existing office/computer desks. For example, in the USA, the existing leg opening for a standard office/computer desk is approximately 24" deep, 25" wide, and 27" high. Realistic dimensions required for a leg opening for an average-size person are smaller, which provides extra space necessary for space-sharing storing multi-segment treadmill under/inside the office desk.

Figure 1:
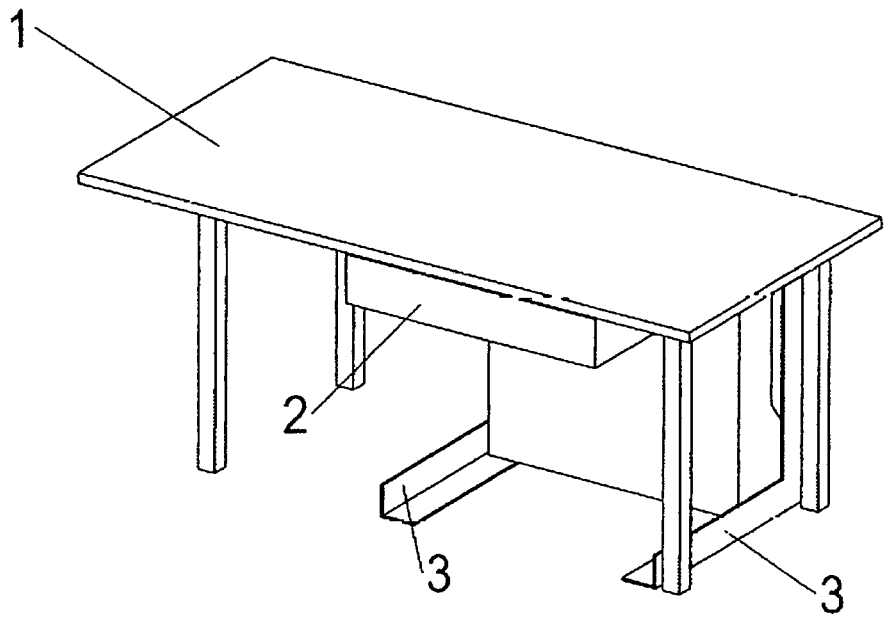
FIGS. 1-4 are schematic illustrations of the storing/revealing process provided by the Automated Assembly.
Figure 5:
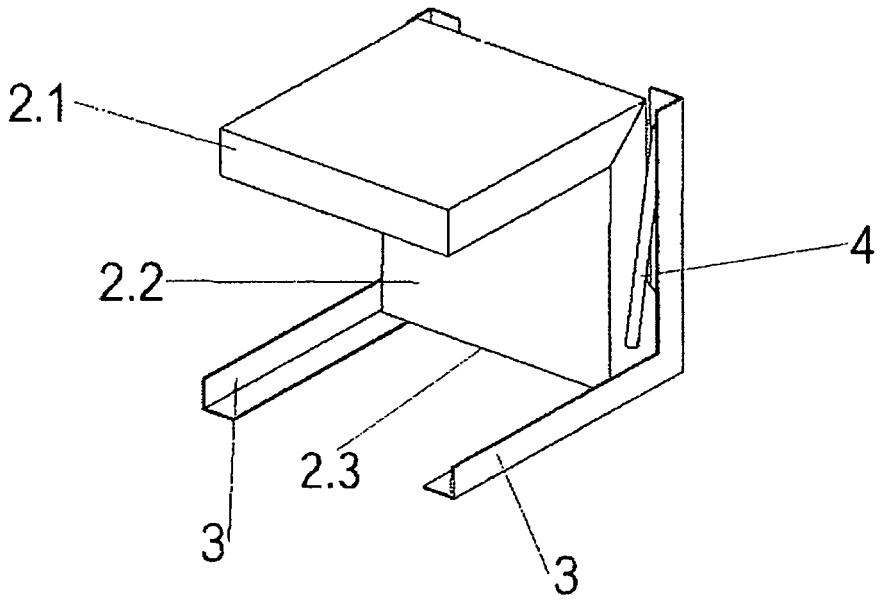
FIGS. 5-8 are schematic illustrations of the same storing/revealing process with omitted office desk.
Figure 12:
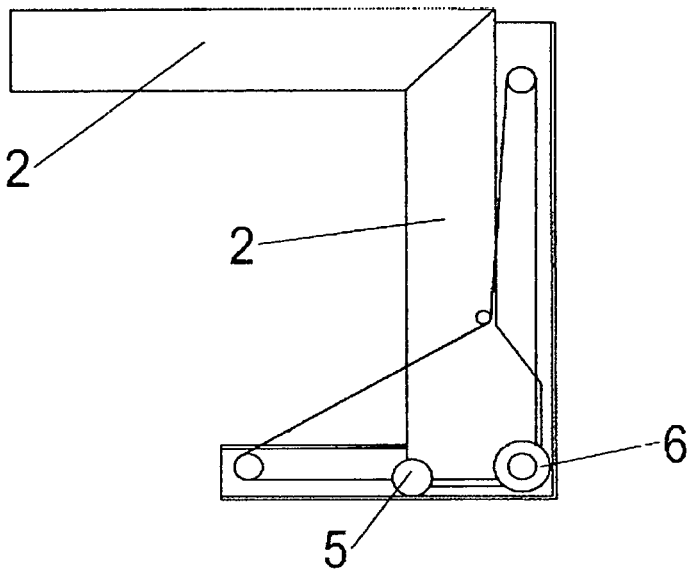

In the space-sharing storing position, the multi-segment treadmill is stored under the office/computer desk as shown on FIGS. 1, 5, and 12. Being actuated, the linear actuators (or a motor) place the multi-segment treadmill flat on the floor, in front of the office/computer desk. This position is shown on FIGS. 3, 7, and 14.

Figure 2:
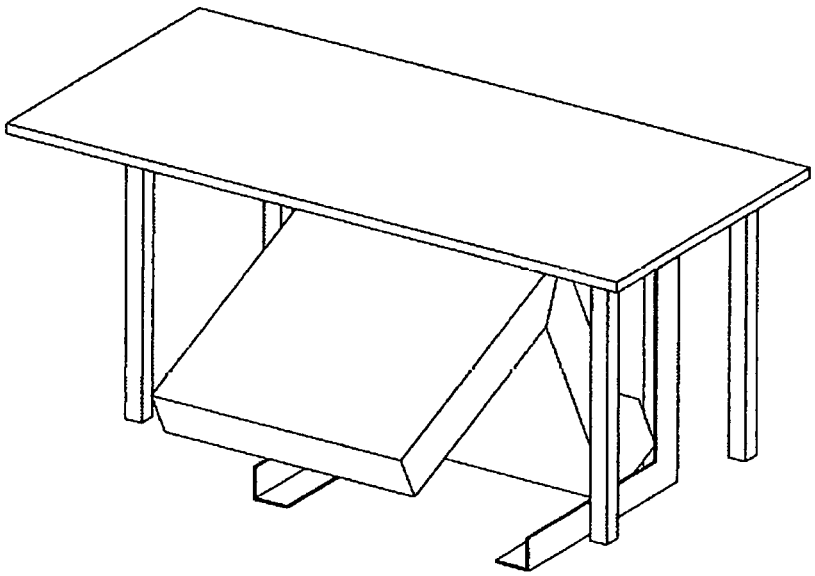
Figure 6:
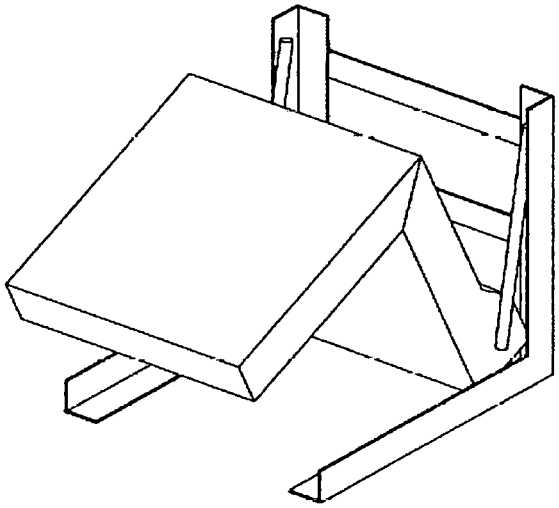
Figure 13:
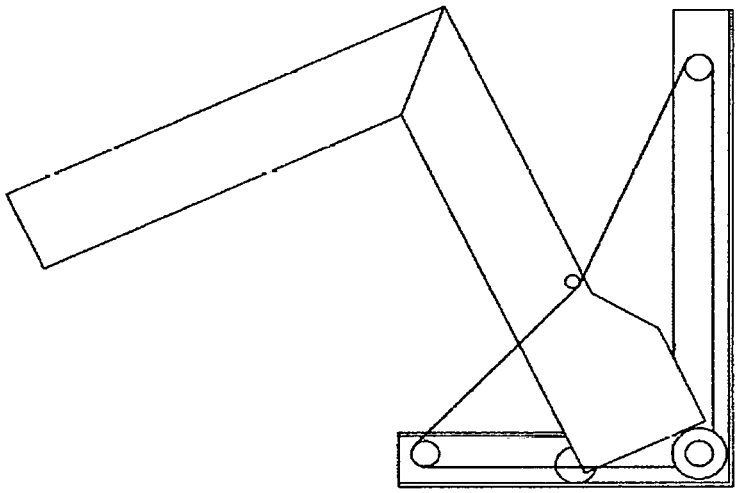

FIGS. 2, 6, and 13 show intermediate (transitional) position of the multi-segment treadmill.

Figure 3:
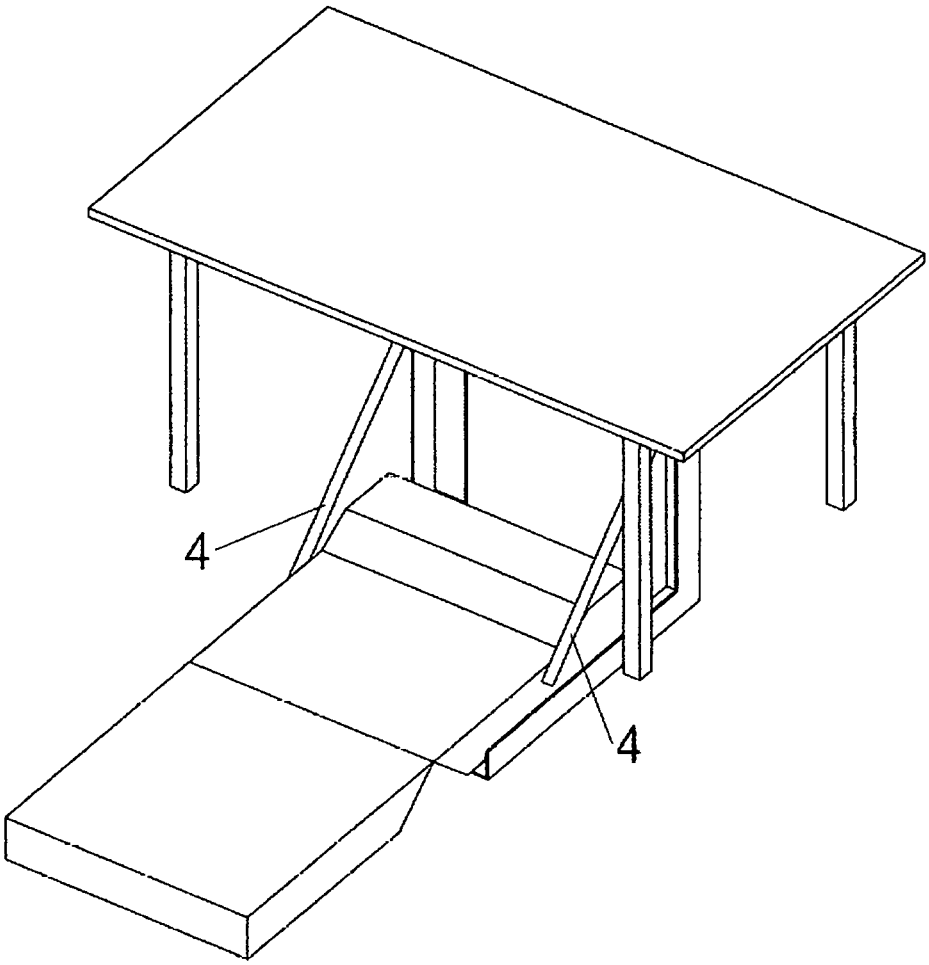
Figure 4:
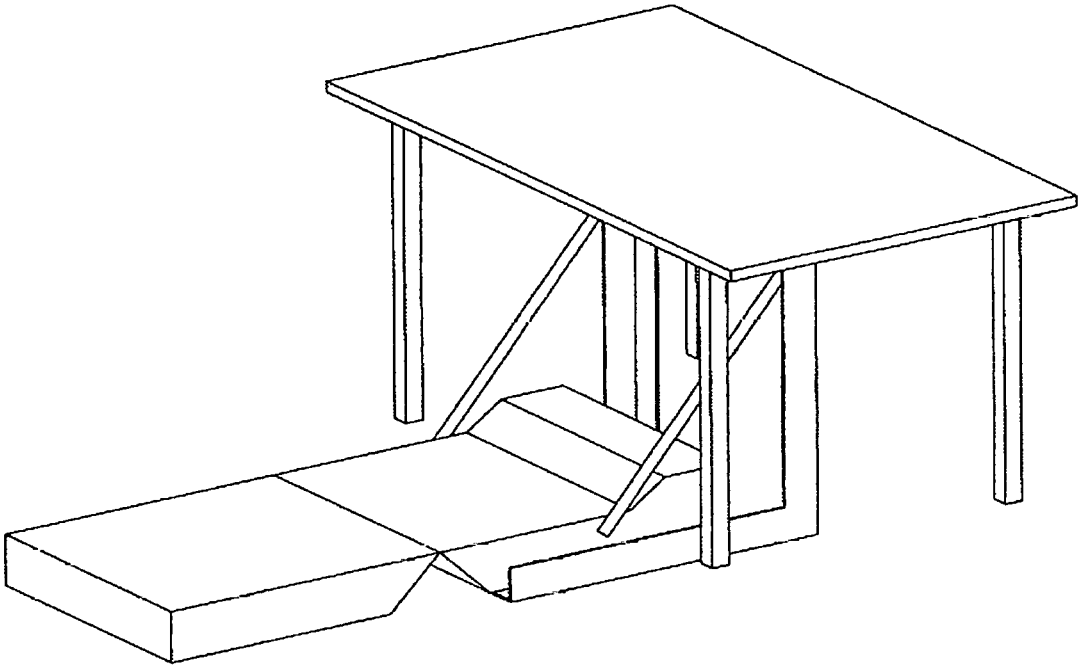
Figure 7:
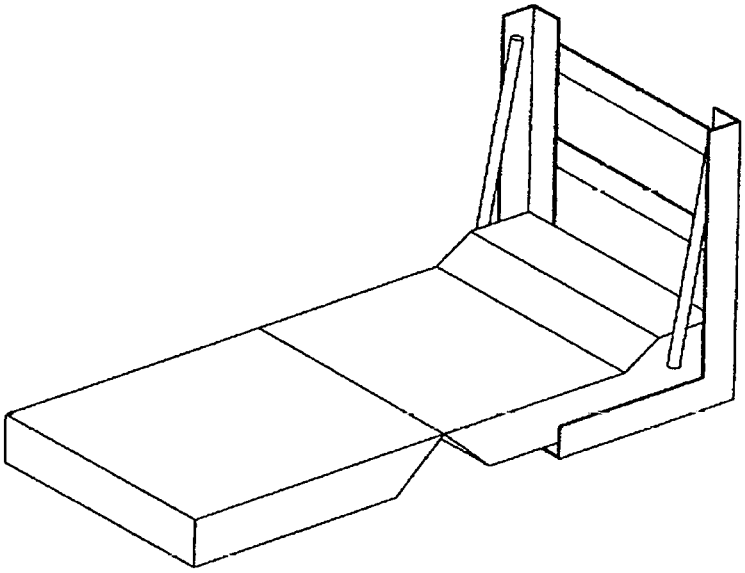
Figure 8:
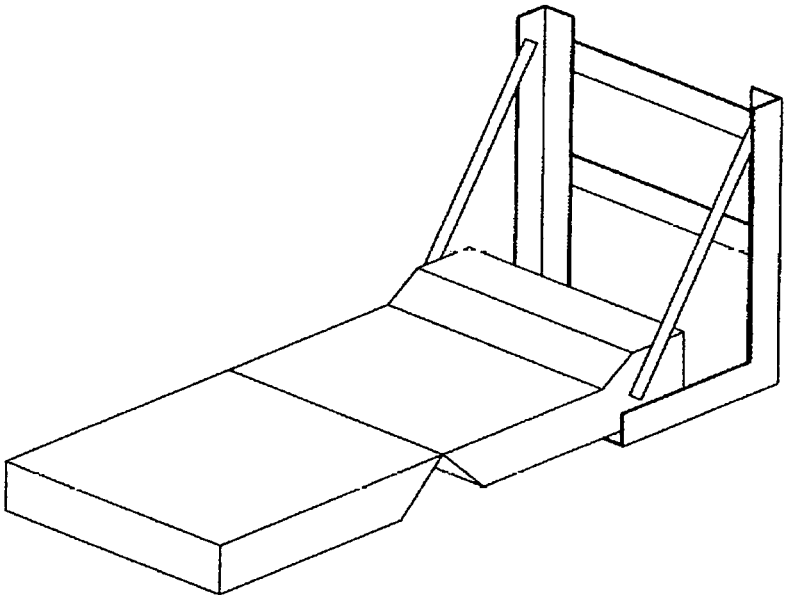
Figure 9:
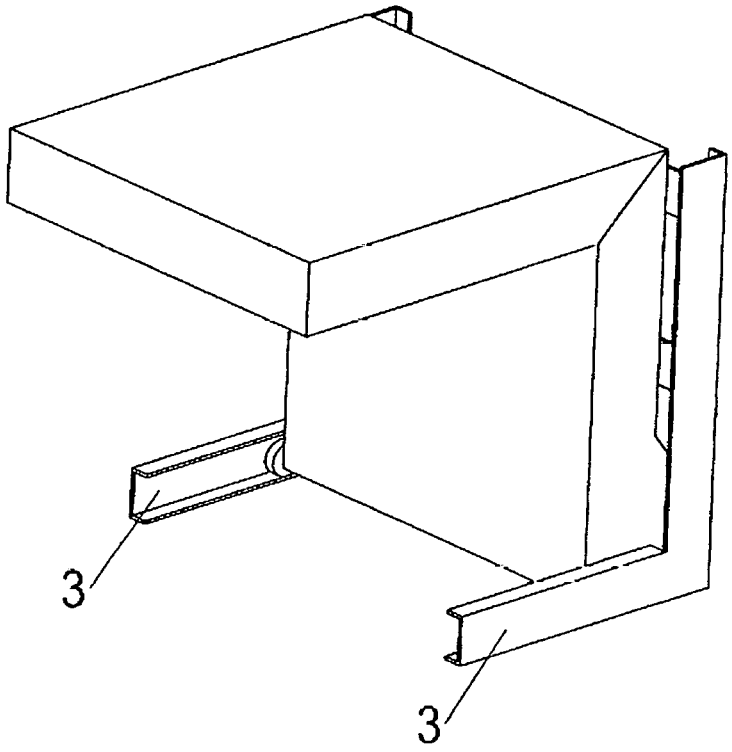
FIGS. 9-15 present the Automated Assembly with a motor in use instead of the linear actuator. Some parts and compensator(s) for a chain or string are omitted on FIGS. 9-15.
Figure 10:
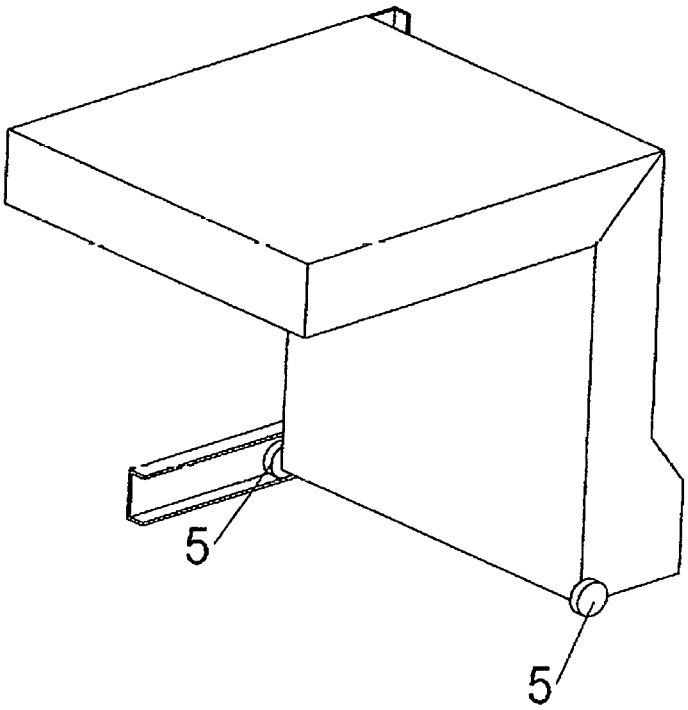
Figure 11:
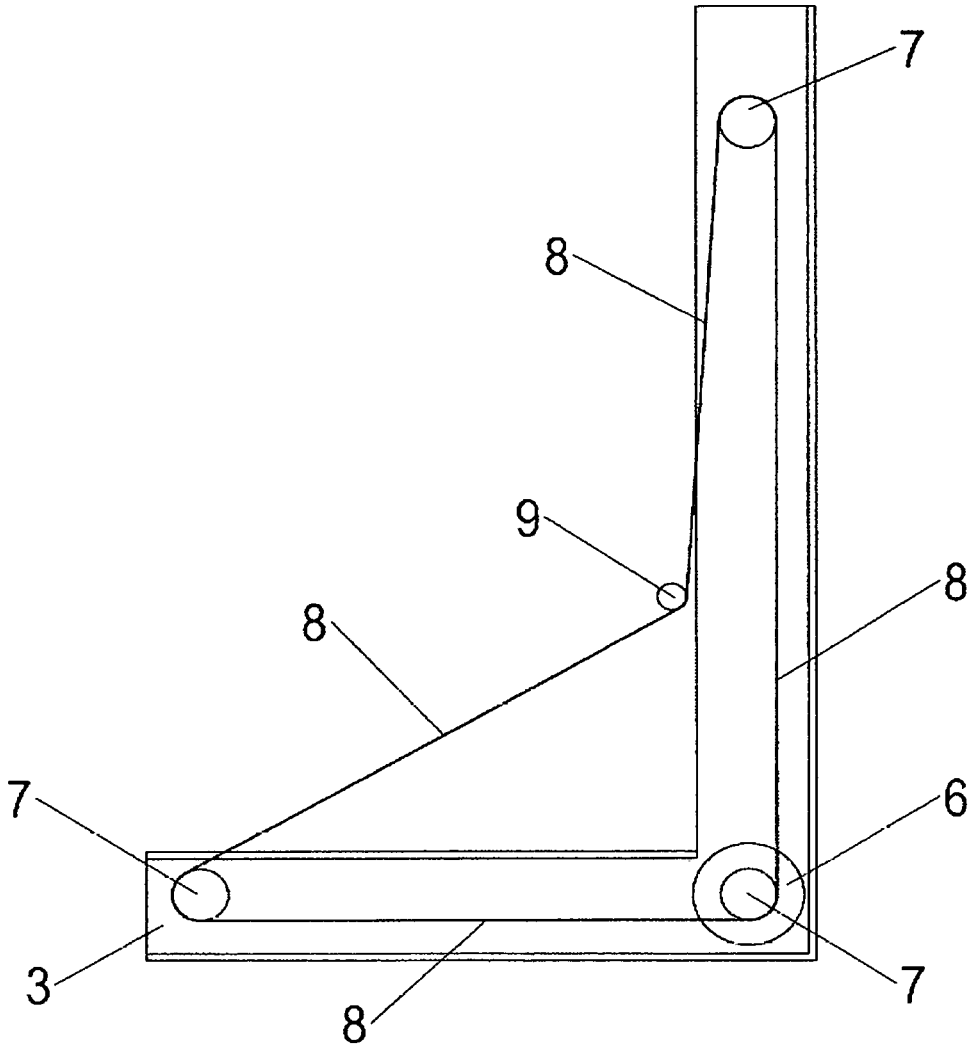
Figure 14:
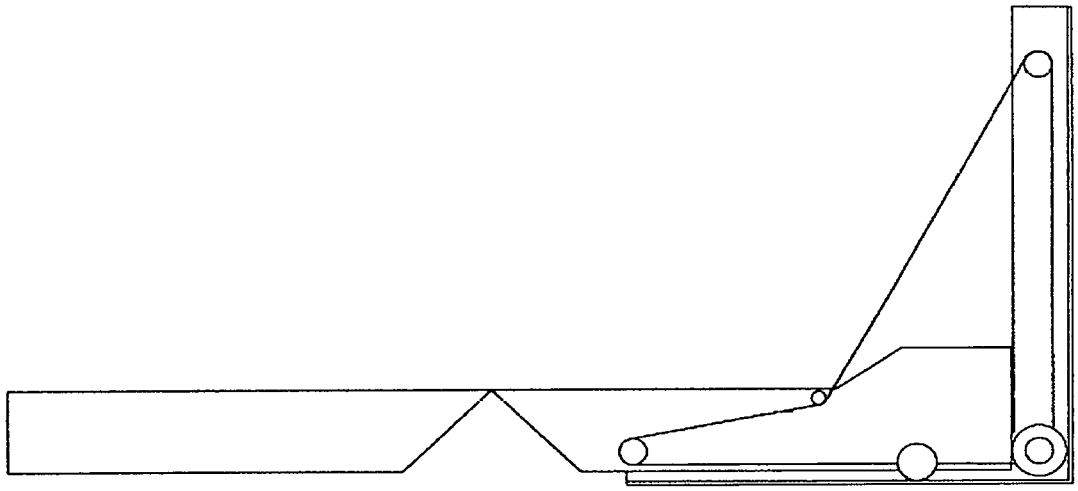
Figure 15:
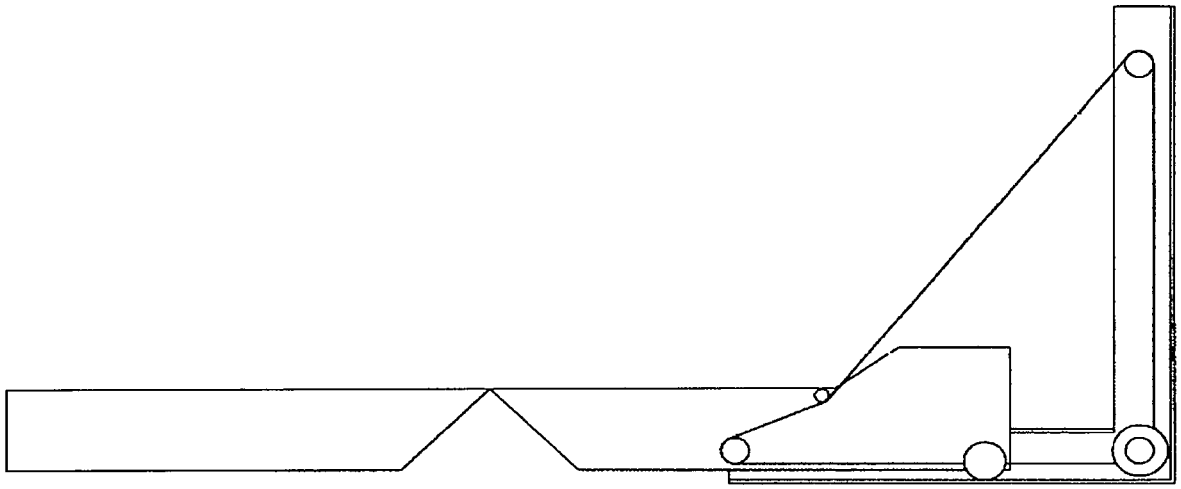

However, the position shown on FIGS. 3, 7, and 14 is not suitable for exercising since the multi-segment treadmill is still too deep under the office/computer desk and must be moved further out. The linear actuators (or a motor) continue moving the multi-segment treadmill to its final revealing (working) position depicted on FIGS. 4, 8, and 15.

The simplest designs of the Automated Assembly are presented while the actual design or each part of it may bear great disparities from the illustrations presented. Chains, strings, spools, connecting rods, gears, etc. could be involved in the storing/revealing process. In the presented embodiments, the frame consists of two L-shaped parts on both sides of the Automated Assembly, but could have various shapes and configurations.

The travel of the multi-segment treadmill from the revealing position in front of the office/computer desk into the space-sharing storing position consists of a combination of three movements:

Movement A: Pulling the entire multi-segment treadmill toward the office/computer desk;

Movement B: Rotating of connected segments of the multi-segment treadmill toward each other. Rotation stops before the inner segment occupies an acute angle toward the outer segment; the design prevents further rotation of segments toward each other and segments cannot fold together or come within an acute angle of each other;

Movement C: Rotation of all connected segments of the multi-segment treadmill around the inner edge of the inner segment until the multi-segment treadmill occupies the space-sharing storing position inside/under of the office/computer desk;

The vice versa transition is the combination of movements C, B, and A with respect to the opposite direction of movements depicted in each paragraph;

The rotation of the outer segment toward the inner segment can be stopped before the outer segment reaches the acute angle with the inner segment by a simple bracket(s).

A design requires the use of a motor instead of a linear actuator presented on FIGS. 9-15. A set consisting of a chain and gears (or a string and spools) could be in use. Powered by a motor (6) attached to the frame (3), a chain or string stores or reveals the multi-segment treadmill. Reference number 9 represents the point of attachment of a chain or string to the multi-segment treadmill. One or more motors can provide the same storing/revealing functionality as a linear actuator(s). (A compensator for a chain or string is omitted on drawings for simplicity.)

The transition from the revealing (working) to the space-sharing storing position may use one or several guides or perforated guiding channels. Those guides may also serve as a part, or shape the entire frame, supporting the transition of the multi-segment treadmill.

Two flat panels on both sides of a treadmill can form a frame of the presented Automatic Assembly as soon as they are strong enough to support the weight of the multi-segment treadmill. A different metal, plastic, wood, or other material could be in use for panels which form the frame. Naturally, a weight of the frame should be as light as possible for handling and transportation reasons. Therefore, panels may be cut into an L-shape similar to the frame (3) presented in this disclosure. The multi-segment treadmill may also use existing panels, like panels on both sides of the leg's opening present in most existing office/computer desks. Finally, some designs may require a frame panel only on one side of the Automated Assembly.

Operation

Both proposed designs, involving the linear actuator(s) or motor(s) provide similar functionality and require two main positions of the multi-segment treadmill. The space-sharing storing position presented by FIGS. 1, 5, and 12, and the revealing (working) position presented by FIGS. 4, 8, and 15. Both positions are self-evident in the above text.

The electric parts of the presented Automated Assembly are not specified for the presented embodiments since they can be designed in many ways and/or independently from the Automated Assembly. For example, the electric control could have a form of a button mounted under the desk, or can be a part of a remote control, together or separate from the on/off function, speed, and positional treadmill controls.

REFERENCE NUMBERS

1—Office desk
2—Multi-segment treadmill
  2.1—The outer segment
  2.2—The inner segment
  2.3—The inner edge of the inner segment
3—Frame consisted of two panels (the panels are L—shaped and reinforced)
4—Linear actuator
5—Bottom roller
6—Motor
7—Gears or spools
8—Chain or cord
9—Point of attachment (of a chain or cord to a multi-segment treadmill)

The invention claimed is:

1. An automated assembly comprising:

a frame comprising two panels, wherein said frame occupies available leg space beneath an office desk on a right side and on a left side of an existing leg opening;

a multi-segment treadmill, said multi-segment treadmill comprising an inner segment and an outer segment;

at least one linear actuator, said at least one linear actuator is connected to the frame and to the multi-segment treadmill;

wherein the said multi-segment treadmill is configured to be movable by the at least one linear actuator, relative to the frame; and the said multi-segment treadmill is configured to be movable from a revealing position in front of the office desk where the inner segment and the outer segment are flat on the floor, and a space-sharing storing position wherein the inner segment and the outer segment are inside of the existing leg opening of the office desk, and is further configured to be movable from the space-sharing storing position to the revealing position;

wherein the inner segment of said multi-segment treadmill is the closest to the office desk and the outer segment is the farthest from the office desk while the multi-segment treadmill is in the revealing position;

wherein a transition of the multi-segment treadmill between the revealing position and the space-sharing storing position consists of a combination of three movements, the three movements comprising movement A, movement B, and movement C; and said movement A is a pulling of the entire multi-segment treadmill toward the office desk; and said movement B is a rotation of the inner segment and the outer segment of the multi-segment treadmill toward each other; said rotation stops prior to the inner segment occupying an acute angle toward the outer segment; wherein the automated assembly prevents additional rotation of the inner segment and the outer segment toward each other and prevents the inner segment and the outer segment from folding together or coming within an acute angle of each other; and said movement C is a rotation of the inner segment and the outer segment of the multi-segment treadmill around an inner edge of the inner segment until the multi-segment treadmill occupies the space-sharing storing position inside of the existing leg opening of the office desk; and wherein a transition of the multi-segment treadmill from the space-sharing position to the revealing position is the combination of the three movements in the order of movement C, movement B, and movement A with respect to an opposite direction of the movements;

wherein said space-sharing storing position allows the inner segment and the outer segment of the multi-segment treadmill to occupy different storage areas within the office desk;

wherein the automated assembly allows a person to work at the office desk by sharing the available leg space with the frame and the multi-segment treadmill while the multi-segment treadmill is in the space-sharing storing position; and in the said space-sharing storing position, the inner segment is positioned at substantially vertical alignment with the floor and the outer segment is positioned at a substantially parallel position with the floor; and in the said space-sharing storing position, the outer segment occupies a space under the flat upper part of the office desk; and in the said space-sharing storing position, the outer segment occupies the available extra space above a sitting person's legs; and in the said space-sharing storing position, the inner segment occupies the available extra space in front of the sitting person's legs.

2. The automated assembly of claim 1, wherein the at least one linear actuator includes two linear actuators.

3. The automated assembly of claim 1, wherein the automated assembly can be a standalone unit.

4. The automated assembly of claim 3, wherein the at least one linear actuator includes two linear actuators.

5. The automated assembly of claim 1, wherein a part of the office desk which shapes the leg opening also serves as a part of the frame such that the at least one linear actuator is coupled to the said multi-segment treadmill and to the part of the office desk.

6. The automated assembly of claim 5, wherein the at least one linear actuator includes two linear actuators.

7. An automated assembly comprising:

a frame comprising two panels, wherein said frame occupies available leg space beneath an office desk on a right side and on a left side of an existing leg opening;

a multi-segment treadmill, said multi-segment treadmill comprising an inner segment and an outer segment;

at least one motor, said at least one motor is connected to the frame and to the multi-segment treadmill;

wherein the said multi-segment treadmill is configured to be movable by the at least one motor, relative to the frame; and the said multi-segment treadmill is configured to be movable from a revealing position in front of the office desk where the inner segment and the outer segment are flat on the floor, and a space-sharing storing position wherein the inner segment and the outer segment are inside of the existing leg opening of the office desk, and is further configured to be movable from the space-sharing storing position to the revealing position;

wherein the inner segment of said multi-segment treadmill is the closest to the office desk and the outer segment is the farthest from the office desk while the multi-segment treadmill is in the revealing position;

wherein a transition of the multi-segment treadmill between the revealing position and the space-sharing storing position consists of a combination of three movements, the three movements comprising movement A, movement B, and movement C; and said movement A is a pulling of the entire multi-segment treadmill toward the office desk; and said movement B is a rotation of the inner segment and the outer segment of the multi-segment treadmill toward each other; said rotation stops prior to the inner segment occupying an acute angle toward the outer segment; wherein the automated assembly prevents additional rotation of the inner segment and the outer segment toward each other and prevents the inner segment and the outer segment from folding together or coming within an acute angle of each other; and said movement C is a rotation of the inner segment and the outer segment of the multi-segment treadmill around an inner edge of the inner segment until the multi-segment treadmill occupies the space-sharing storing position inside of the existing leg opening of the office desk; and wherein a transition of the multi-segment treadmill from the space-sharing position to the revealing position is the combination of the three movements in the order of movement C, movement B, and movement A with respect to an opposite direction of the movements;

wherein said space-sharing storing position allows the inner segment and the outer segment of the multi-segment treadmill to occupy different storage areas within the office desk;

wherein the automated assembly allows a person to work at the office desk by sharing the available leg space with the frame and the multi-segment treadmill while the multi-segment treadmill is in the space-sharing storing position; and in the said space-sharing storing position, the inner segment is positioned at substantially vertical alignment with the floor and the outer segment is positioned at a substantially parallel position with the floor; and in the said space-sharing storing position, the outer segment occupies a space under the flat upper part of the office desk; and in the said space-sharing storing position, the outer segment occupies the available extra space above a sitting person's legs; and in the said space-sharing storing position, the inner segment occupies the available extra space in front of the sitting person's legs.

8. The automated assembly of claim 7, wherein the at least one motor includes two motors.

9. The automated assembly of claim 7, wherein the automated assembly can be a standalone unit.

10. The automated assembly of claim 9, wherein the at least one motor includes two motors.

11. The automated assembly of claim 7, wherein a part of the office desk which shapes the leg opening also serves as a part of the frame such that the at least one motor is coupled to the said multi-segment treadmill and to the part of the office desk.

12. The automated assembly of claim 11, wherein the at least one motor includes two motors.

* * * * *